US007580010B2

(12) United States Patent
Kim

(10) Patent No.: US 7,580,010 B2
(45) Date of Patent: Aug. 25, 2009

(54) PLASMA DISPLAY PANEL AND DRIVING METHOD THEREOF

(75) Inventor: Joon-Koo Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 714 days.

(21) Appl. No.: 10/963,635

(22) Filed: Oct. 14, 2004

(65) Prior Publication Data

US 2005/0093853 A1 May 5, 2005

(30) Foreign Application Priority Data

Oct. 16, 2003 (KR) ..... 10-2003-0072322

(51) Int. Cl.
*G09G 3/28* (2006.01)

(52) U.S. Cl. ..... 345/67; 345/60; 345/68

(58) Field of Classification Search ..... 345/60–67, 345/41–42

See application file for complete search history.

(56) References Cited

U.S. PATENT DOCUMENTS

| | | | | |
|---|---|---|---|---|
| 6,249,087 | B1 * | 6/2001 | Takayama et al. | 315/169.1 |
| 6,674,419 | B2 * | 1/2004 | Ilcisin et al. | 345/66 |
| 7,012,579 | B2 * | 3/2006 | Choi | 345/60 |
| 7,286,102 | B2 * | 10/2007 | Yoon et al. | 345/60 |
| 2001/0017605 | A1 | 8/2001 | Hashimoto et al. | |
| 2002/0190930 | A1 * | 12/2002 | Shiizaki et al. | 345/63 |
| 2003/0174102 | A1 * | 9/2003 | Jeong | 345/60 |
| 2004/0246206 | A1 * | 12/2004 | Choi | 345/60 |

FOREIGN PATENT DOCUMENTS

| | | |
|---|---|---|
| CN | 1409284 | 4/2003 |
| JP | 2000-206933 | 7/2000 |
| JP | 2001-013911 | 1/2001 |
| JP | 2001-184023 | 7/2001 |
| JP | 2001-318645 | 11/2001 |
| JP | 2002-215090 | 7/2002 |
| JP | 2002-258794 | 9/2002 |
| JP | 2003-084712 | 3/2003 |
| JP | 2003-157042 | 5/2003 |
| JP | 2003-177704 | 6/2003 |
| JP | 2003-248455 | 9/2003 |
| JP | 2003-295814 | 10/2003 |

* cited by examiner

*Primary Examiner*—Amare Mengistu
*Assistant Examiner*—Robert R Rainey
(74) *Attorney, Agent, or Firm*—H.C. Park & Associates, PLC

(57) ABSTRACT

Disclosed are a PDP and a driving method thereof. A falling ramp, having the same or greater gradient as that of a falling ramp pulse applied to a Y electrode, is applied to an X electrode in part of a Y ramp falling period during which a falling ramp pulse is applied to the Y electrode. Therefore, high-rate addressing may be allowed and discharge efficiency may be improved since the maximum wall voltage may be formed within a range in which no erroneous discharge may be generated to the X and Y electrodes in a reset period.

13 Claims, 3 Drawing Sheets

PLASMA DISPLAY PANEL AND DRIVING METHOD THEREOF

This application claims the benefit of Korea Patent Application No. 10-2003-0072322, filed on Oct. 16, 2003, which is hereby incorporated by reference for all purposes as if fully set forth herein.

BACKGROUND OF THE INVENTION

1. Field of the Invention

The present invention relates to a plasma display panel (PDP) driving method. More specifically, the present invention relates to a method for driving a PDP with a reduced reset time.

2. Discussion of the Related Art

Recently, liquid crystal displays (LCDs), field emission displays (FEDs), and PDPs have been actively developed. Generally, PDPs may have better luminance and light emission efficiency compared to other types of flat panel display devices, and they may also have wider viewing angles. Therefore, PDPs are receiving attention as substitutes for the conventional cathode ray tubes (CRTs) for displays bigger than 40 inch displays.

A PDP uses plasma, generated via a gas discharge process, to display characters or images, and tens of thousands to millions of pixels may be provided in a matrix format, depending on its size. Depending upon driving voltage waveforms and discharge cell structures, PDPs are typically categorized into direct current (DC) PDPs or alternating current (AC) PDPs.

Since DC PDPs have exposed electrodes in the discharge space, they allow a current to flow in the discharge space while the voltage is supplied, which requires resistors for current restriction. On the other hand, an AC PDPs electrodes are covered by a dielectric layer, and capacitances are naturally formed to restrict the current. Additionally, the dielectric layer protects the electrodes from ion shocks during discharging. Accordingly, AC PDPs have a longer lifespan than DC PDPs.

FIG. 1 shows a perspective view of an AC PDP.

As shown, a pair of a scan electrode 4 and a sustain electrode 5, disposed over a dielectric layer 2 and a protection film 3, are provided in parallel under a first glass substrate 1. A plurality of address electrodes 8, covered with an insulation layer 7, is installed on a second glass substrate 6. Barrier ribs 9, which are parallel to the address electrodes 8, are formed on the insulation layer 7 between the address electrodes 8. Phosphor 10 is formed on the surface of the insulation layer 7 between the barrier ribs 9. The first and second glass substrates 1 and 6, which have a discharge space 11 between them, face each other so that the scan electrode 4 and the sustain electrode 5 pair may cross the address electrodes 8 at right angles. The address electrodes 8, the scan electrode 4 and the sustain electrode 5 pair, and the discharge space 11 form a discharge cell 12.

FIG. 2 shows a PDP electrode arrangement diagram.

As shown in FIG. 2, PDP electrodes are configured in a matrix. Specifically, address electrodes $A_1$ to $A_m$ are formed in the column direction, and scan electrodes $Y_1$ to $Y_n$ (Y electrodes) and sustain electrodes $X_1$ to $X_n$ (X electrodes) are alternately formed in the row direction. The discharge cell 12 shown in FIG. 2 corresponds to the discharge cell 12 shown in FIG. 1.

FIG. 3 shows a conventional PDP driving waveform diagram.

According to the conventional PDP method shown in FIG. 3, each subfield includes a reset period, an address period, and a sustain period.

The reset period, which includes an erase period, a Y ramp rising period, and a Y ramp falling period, erases wall charge states of a previous sustain, and sets up wall charges in order to stably perform a next address.

In the address period, panel cells to be turned on are selected, and wall charges accumulate to the selected cells (i.e., the addressed cells). In the sustain period, discharges for displaying pictures with the addressed cells is performed.

The wall charges are charges formed on the wall (e.g., a dielectric layer) of the discharge cell near each electrode and accumulate on the electrode. The wall charges do not actually contact the electrode, but they may be described to be "formed," "accumulated," and "piled" on the electrode. Also, the wall voltage represents a potential difference formed on the discharge cell wall by the wall charges.

In order to improve the PDP's efficiency, over 10% of Xe may be utilized in the discharge gas, and the discharge firing voltage increases as the rate of Xe increases. Therefore, the voltage at the Y electrode is reduced to the negative voltage in the Y ramp falling period, and the scan pulse applied to the Y electrode is reduced to the negative voltage in the address period.

A discharge in the address period is generated after a time corresponding to an address discharge delay time is passed starting from a time when data pulses are applied to the Y electrode and X electrode. But, when the address discharge delay time is greater than the address time allocated to one scan line, the address discharge fails. Therefore, the cell that is not accurately addressed will not be discharged in the following sustain discharge period, as it should be.

Therefore, as shown in the driving waveform of FIG. 4, the address discharge delay time is reduced by lowering the voltage at the Y electrode to a negative voltage of Vnf in the falling reset period and applying a negative voltage of Vscl which is a scan pulse and is lower than the voltage of Vnf to the Y electrode in the address period. Accordingly, per the driving waveform of FIG. 4, the address discharge delay time may be reduced by applying a negative voltage of Vscl, which is lower than the voltage of Vnf, at the Y electrode after the falling ramp through the scan pulse applied to the Y electrode in the address period.

But when a low negative voltage is applied to the Y electrode, an erroneous sustain discharge may be generated between it and the address electrode of a non-selected cell.

SUMMARY OF THE INVENTION

The present invention provides a PDP driving device and method for generating reset waveforms that may enable a high success rate of address discharges and prevent erroneous sustain discharges.

Additional features of the invention will be set forth in the description which follows, and in part will be apparent from the description, or may be learned by practice of the invention.

The present invention discloses a method for driving a PDP comprising applying a first waveform, which falls from a first voltage to a second voltage, to a first electrode during a first period of a reset period, and lowering a voltage at a second electrode from a third voltage to a fourth voltage during a part of the first period.

The present invention also discloses a PDP comprising a first substrate and a second substrate facing each other with a gap therebetween, a plurality of address electrodes arranged on the first substrate, and a plurality of first electrodes and a plurality of second electrodes arranged on the second substrate. The plurality of first electrodes and the plurality of second electrodes are parallel to each other and orthogonal to the plurality of address electrodes. A driving circuit transmits signals to a first electrode, a second electrode, and an address electrode in a reset period, an address period, and a sustain period. In the reset period, the driving circuit applies a first ramp waveform, which falls from a first voltage to a second voltage, to the first electrode during a first period. A voltage at the second electrode falls from a third voltage to a fourth voltage during a part of the first period.

The present invention also discloses a method for driving a plasma display panel (PDP), comprising applying a first waveform, which falls from a first voltage to a second voltage, to a first electrode during a first period of a reset period, and lowering a voltage at a second electrode from a third voltage to a fourth voltage during a part of the first period. A second voltage is applied to the first electrode in an address period, and a fifth voltage, which is greater than the third voltage, is applied to the second electrode in an address period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of the specification, illustrate embodiments of the invention and together with the description serve to explain the principles of the invention.

DETAILED DESCRIPTION OF THE PREFERRED EMBODIMENTS

Figure 1:
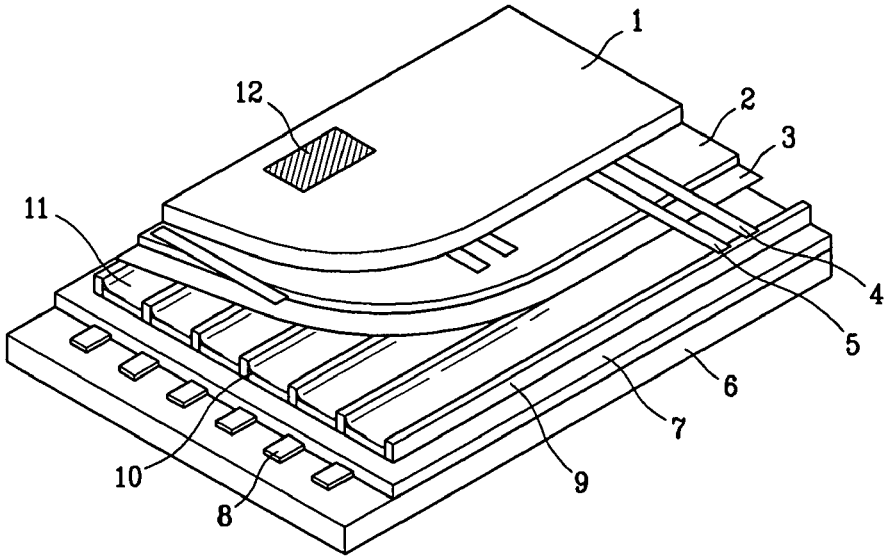
FIG. 1 (Prior Art)
FIG. 1 shows a partial perspective view of an AC PDP.
Figure 2:
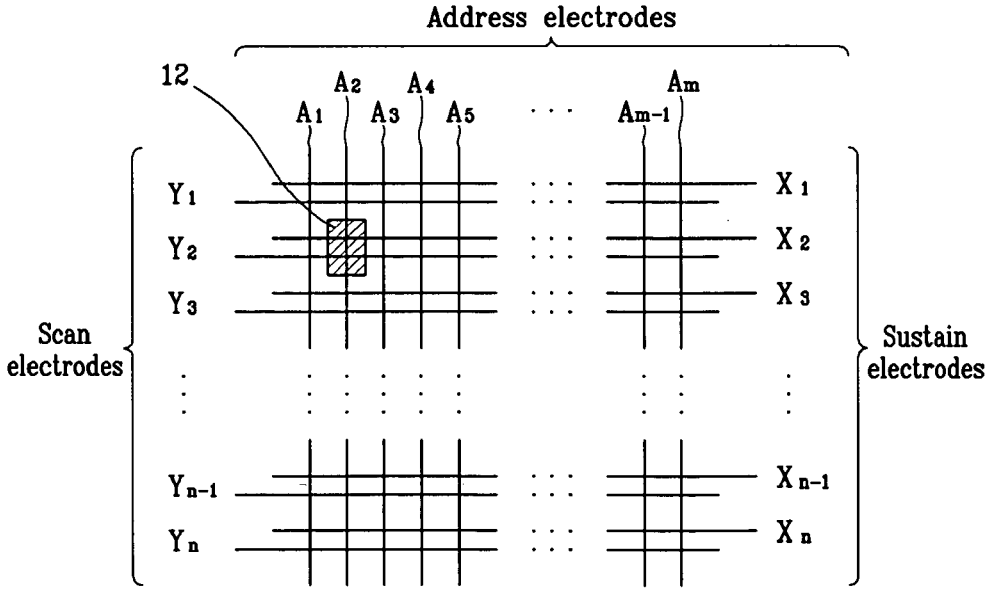
FIG. 2 (Prior Art)
FIG. 2 shows a PDP electrode arrangement diagram.
Figure 3:
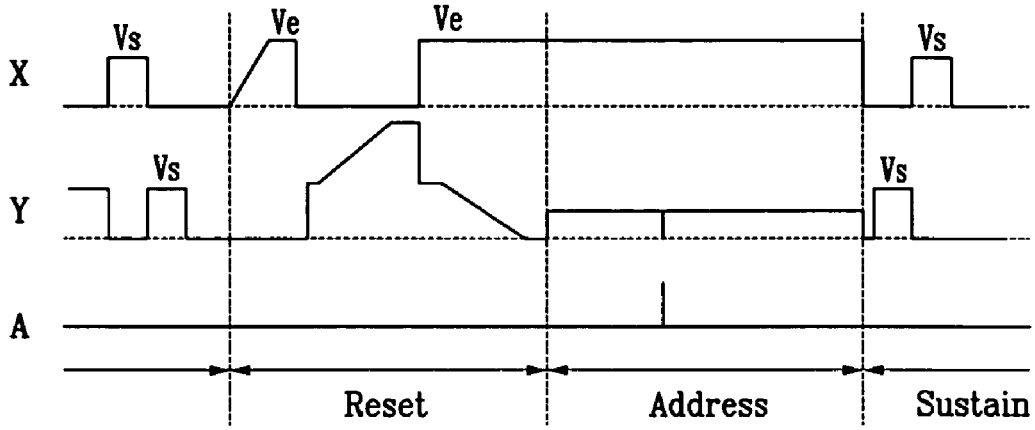
FIG. 3(Prior Art)
FIG. 3 shows a conventional PDP driving waveform diagram.
Figure 4:
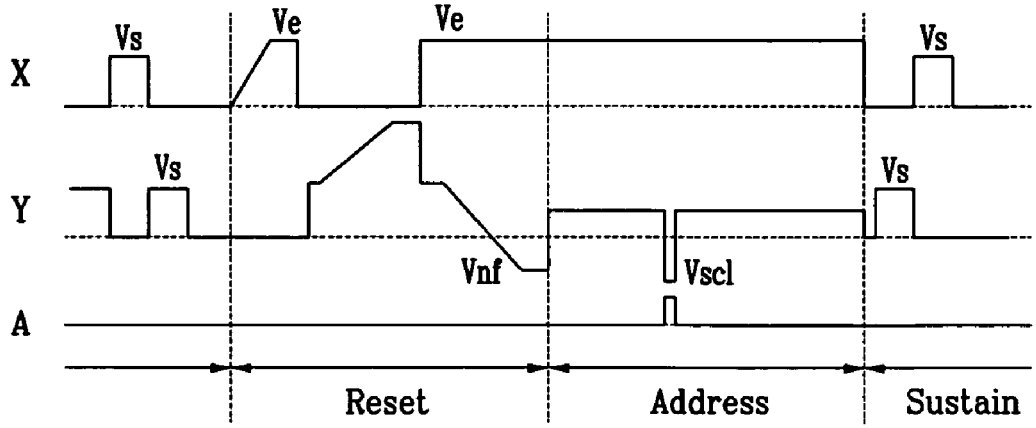
FIG. 4(Prior Art)
FIG. 4 shows a conventional PDP driving waveform diagram.

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive. To clarify the present invention, parts that are not described in the specification are omitted, and parts for which similar descriptions are provided have the same reference numerals.

A PDP driving method according to the first exemplary embodiment of the present invention will be described with reference to FIG. 5.

Figure 5:
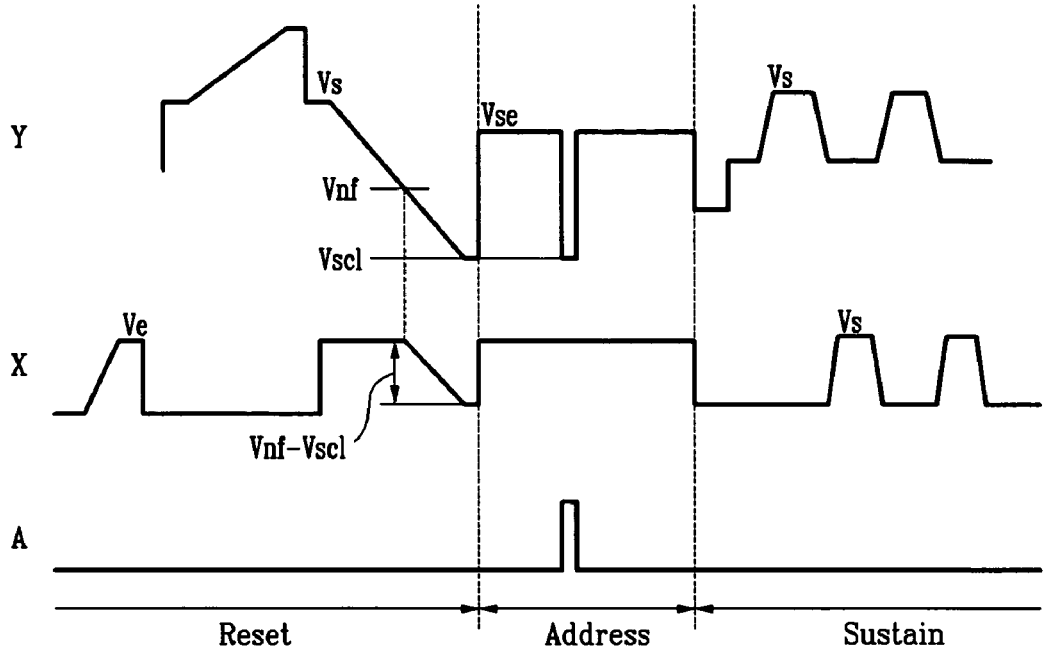
FIG. 5 shows a driving waveform diagram according to a first exemplary embodiment of the present invention.

FIG. 5 shows a driving waveform diagram according to a first exemplary embodiment of the present invention.

As shown, in the Y ramp falling period, a ramp pulse that falls from a positive voltage of Vs to a negative voltage of Vscl is applied to the Y electrode. While the voltage at the Y electrode is reduced from the negative voltage of Vnf to the negative voltage of Vscl, a falling ramp having a gradient with an absolute value that is greater than or equal to the absolute value of the gradient of the Y falling ramp, is applied to the X electrode.

When the falling ramp pulse is applied to the Y electrode in this state, a weak discharge is generated so that the negative charges accumulated on the Y electrode in the Y ramp rising period and the positive charges on the X electrode are gradually erased.

After this, since the voltage at the Y electrode is gradually reduced by the Y falling ramp pulse, and the falling ramp pulse is applied to the X electrode, the voltage difference between the X and Y electrodes is maintained at the same state, or is reduced when the voltage at the Y electrode is reduced. Hence, the weak discharge between the X and Y electrodes may be suppressed.

Also, since the potential of the X and Y electrodes decreases, the potential difference between the address electrode and the X and Y electrodes increases, and the potential difference at the end of the reset period is a voltage that is slightly less than the discharge firing voltage between the address electrode and the Y electrode.

Therefore, when the address period starts, no erroneous discharges may occur between the address electrode and the Y electrode of non-selected cells, and no erroneous discharges may occur between the X and Y electrodes, since the potential difference between the address electrode and the X and Y electrodes is less than the discharge firing voltage between the address electrode and the Y electrode.

Additionally, since the wall voltage caused by the wall charges accumulated on the X and Y electrodes in the reset period is maximized within the range in which no erroneous discharge is generated, a high-rate address discharge may be generated in the address period.

In the first exemplary embodiment of the present invention, equal voltages of Ve are applied to the X electrode in the reset and address periods. In the second exemplary embodiment of FIG. 6, however, the voltage of Ve' applied to the X electrode in the address period is greater than the voltage of Ve applied to the X electrode during the reset period. This may better prevent erroneous discharges in the address period.

Figure 6:
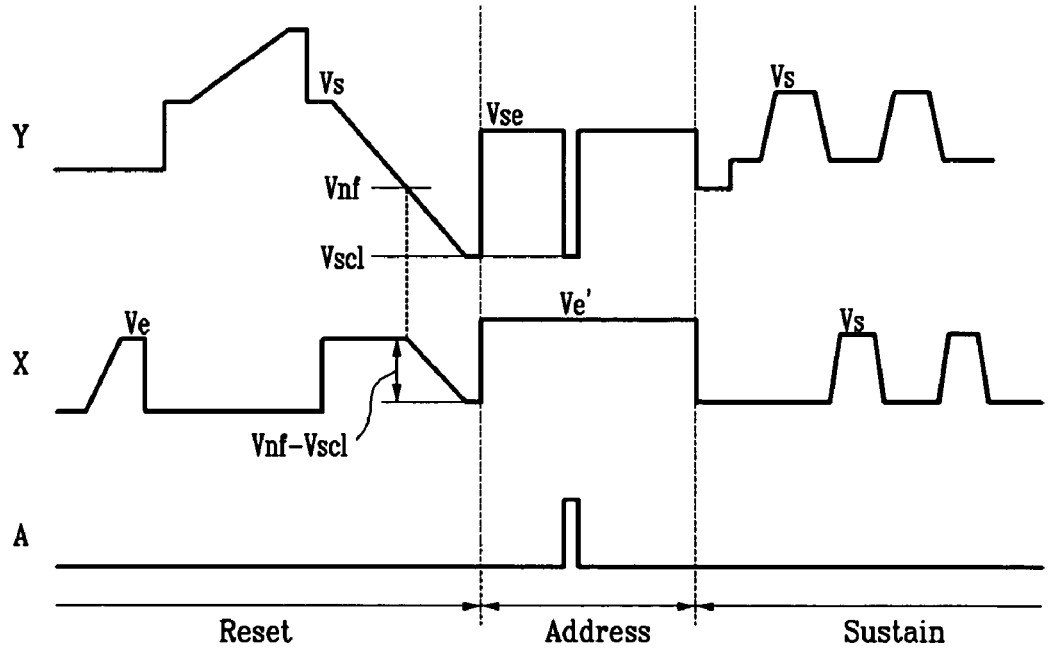
FIG. 6 shows a driving waveform diagram according to a second exemplary embodiment of the present invention.

FIG. 6 shows a driving waveform diagram according to a second exemplary embodiment of the present invention.

Similar to the first exemplary embodiment, a falling ramp, which has a gradient with an absolute value that is greater than or equal to the absolute value of the gradient of the Y falling ramp, may be applied to the X electrode while the voltage at the Y electrode is reduced from the negative voltage of Vnf to the negative voltage of Vscl. The voltage at the X electrode may be floated with the voltage of Ve while the voltage at the Y electrode is reduced from the negative voltage of Vnf to the negative voltage of Vscl.

Since negative charges accumulate on the Y electrode and positive charges accumulate on the X electrode when the voltage at the Y electrode is reduced to the negative voltage of Vnf, the X and Y electrodes function as a capacitor that tends to maintain a constant voltage. Therefore, after being floated with the voltage of Ve, the X electrode attempts to maintain the voltage difference with the Y electrode while the voltage at the Y electrode falls from the negative voltage of Vnf to the negative voltage of Vscl. Consequently, the voltage at the X electrode decreases with the voltage at the Y electrode, as would happen if a falling ramp were applied to the X electrode.

According to exemplary embodiments of the present invention, high-rate addressing may be allowed and discharge efficiency may be improved since the maximum wall voltage may be formed within the range in which no erroneous discharge is generated at the X and Y electrodes in the reset period.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel (PDP) having a first substrate and a second substrate facing each other with a gap therebetween; a plurality of address electrodes arranged on the first substrate; a plurality of first electrodes and a plurality of second electrodes arranged on the second substrate; wherein the plurality of first electrodes and the plurality of second electrodes are parallel to each other and orthogonal to the pluralitv of address electrodes, comprising:

gradually decreasing a voltage at a first electrode from a first voltage to a second voltage, while a third voltage is applied to a second electrode during a first period in a reset period; and lowering a voltage at the second electrode from the third voltage to a fourth voltage while the voltage at the first electrode is gradually decreased from the second voltage to a fifth voltage in a second period being consecutive to the first period.

2. The method of claim 1, wherein the voltage at the second electrode is lowered from the third voltage to the fourth voltage by floating the second electrode.

3. The method of claim 1, wherein the voltage at the second electrode is lowered from the third voltage to the fourth voltage by applying to the second electrode a waveform that falls from the third voltage to the fourth voltage.

4. The method of claim 3, wherein an absolute value of a gradient of the waveform that falls from the third voltage to the fourth voltage is greater than or equal to an absolute value of a gradient of a waveform applied to the first electrode to gradually decrease the voltage at the first electrode from the second voltage to the fifth voltage.

5. The method of claim 1, further comprising:

applying the fifth voltage to the first electrode in an address period.

6. The method of claim 1, wherein after the first period, a potential difference between an address electrode and the first electrode, and a potential difference between the address electrode and the second electrode, are less than a discharge firing voltage.

7. The method of claim 1, further comprising:

applying a sixth voltage, which is greater than the third voltage, to the second electrode in an address period.

8. The method of claim 1, wherein in a part of the second period, a voltage at the first electrode is the fifth voltage.

9. The method of claim 1, wherein a voltage difference between the first electrode and the second electrode stays the same while the voltage at the second electrode is lowered from the third voltage to the fourth voltage.

10. A plasma display panel (PDP), comprising:

a first substrate and a second substrate facing each other with a gap therebetween;

a plurality of address electrodes arranged on the first substrate;

a plurality of first electrodes and a plurality of second electrodes arranged on the second substrate; and a driving circuit for transmitting signals to a first electrode, a second electrode, and an address electrode in a reset period, an address period, and a sustain period, wherein the plurality of first electrodes and the plurality of second electrodes are parallel to each other and orthogonal to the plurality of address electrodes, wherein, in the reset period, the driving circuit gradually decreases a voltage at the plurality of first electrodes from a first voltage to a second voltage, while applying a third voltage to the plurality of second electrodes during a first period of the reset period, and lowers a voltage at the plurality of second electrodes from the third voltage to a fourth voltage, while gradually decreasing the voltage at the plurality of first electrodes from the second voltage to a fifth voltage in a second period being consecutive to the first period of the reset period.

11. The PDP of claim 10, wherein a magnitude of the fifth voltage corresponds to a magnitude of a negative voltage applied to the first electrode in the address period.

12. The PDP of claim 10, wherein after the first period, a potential difference between the address electrode and the first electrode, and a potential difference between the address electrode and the second electrode, is less than a discharge firing voltage.

13. The PDP of claim 10, wherein in a part of the second period, a voltage at the first electrode becomes the fifth voltage.

* * * * *

UNITED STATES PATENT AND TRADEMARK OFFICE

CERTIFICATE OF CORRECTION

PATENT NO. : 7,580,010 B2
APPLICATION NO. : 10/963635
DATED : August 25, 2009
INVENTOR(S) : Joon-Koo Kim It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1049 days.

Signed and Sealed this

Fourteenth Day of September, 2010

David J. Kappos

David J. Kappos
*Director of the United States Patent and Trademark Office*